United States Patent [19]

Jackson

[11] Patent Number: 5,060,482

[45] Date of Patent: Oct. 29, 1991

[54] CONTINUOUSLY OPERATING 3HE-$^4$HE DILUTION REFRIGERATOR FOR SPACE FLIGHT

[76] Inventor: Henry W. Jackson, 222 S. Holliston #305, Pasadena, Calif. 91106

[21] Appl. No.: 470,303

[22] Filed: Jan. 25, 1990

[51] Int. Cl.$^5$ ..... F25B 19/00

[52] U.S. Cl. ..... 62/51.3; 62/467

[58] Field of Search ..... 62/51.3, 467

[56] References Cited

U.S. PATENT DOCUMENTS

| | | | |
|---|---|---|---|
| 3,195,322 | 7/1965 | London | 62/51.3 |
| 3,202,160 | 8/1965 | Barger | 137/1 |
| 4,136,526 | 1/1979 | Chanin et al. | 62/51.3 |
| 4,499,737 | 2/1985 | Binnig et al. | 62/56 |
| 4,672,823 | 6/1987 | Benoit et al. | 62/51.3 |
| 4,770,006 | 9/1988 | Roach et al. | 62/51.3 |

OTHER PUBLICATIONS

H. W. Jackson, "Millikelvin Range Refrigerator for Sensor Cooling", JPL New Technology Report No. NPO-15720 (May 1981).

H. W. Jackson, "Can $^3$He-$^4$He Dilution Refrigerators Operate Aboard Spacecraft", Cryogenics 22, pp. 59-61 (May 1982).

H. W. Jackson, "Electrostriction in Liquid $^4$He", Phys. Rev. B. 25, pp. 3127-3131 (Jun. 1982).

D. Petrac, U. E. Israelson, H. W. Jackson, "Electric Field Generated Forces in Liquid $^4$He and in $^3$He/$^4$He Mixtures", Japanese J. Applied Phys. 26, pp. 45&46, Supplement 26-3 (Sep. 1987).
(18th Int. Conf. on Low Temp. Phys. Proc., Kyoto (Jun. 1987)).

U. E. Israelsson, H. W. Jackson, and D. Petrac, "Liquid/Vapor Phase Separation in $^4$He Using Electric Fields", Cryogenics 28, pp. 120-126, (7/1988).

U. E. Israelsson, H. W. Jackson, D. Petrac, "Control of the Interface Between $^3$He-Rich and $^4$He-Rich Phases Using Electric Fields", *Advances in Cryogenic Engineering 33,* pp. 713-717, edited by R. Fast (Plenum, New York, 2/1988).

V. A. Mikheev, V. A. Maidanov, N. P. Mikhin, "Compact Dilution Refrigerator with a Cryogenic Circulation Cycle of $^3$He", Cryogenics 24, p. 190 (6/1984).

O. V. Lounasmaa, *Experimental Principles and Methods Below 1 K,* (Academic, New York, 5/1974), Chapter 3.

J. C. Wheatley, R. E. Rapp, R. T. Johnson, "Principles and Methods of Dilution Refrigeration II", J. Low Temp. Phys. 4, pp. 1-39 (3/1971).

J. S. Stratton, *Electromagnetic Theory* (McGraw-Hill, New York, 9/1941), Chapter 2, Sections 2.21 and 2.25.

H. A. Pohl, *Dielectrophoresis, the Behavior of Neutral Matter in Nonuniform Electric Fields* (Cambridge University Press, New York, 5/1978), Chapter 17.

J. B. Blackmon, "Collection of Liquid Propellants in Zero Gravity with Electric Fields", J. Spacecraft 2, pp. 391-398 (10/1965).

J. M. Meed & J. D. Craggs, *Electrical Breakdown of Gases* (Clarendon Press, Oxford, 7/1953).

(List continued on next page.)

*Primary Examiner*—Ronald C. Capossela
*Attorney, Agent, or Firm*—William W. Haefliger

[57] ABSTRACT

A dilution refrigerator, the combination comprising an electrostatic mixing chamber containing $^3$He-rich and $^4$He-rich phases subject to separation in response to electrostatic force application, the chamber having an outlet for $^3$He that has passed through an interface between those two liquid phases to produce cooling; a still connected with the mixing chamber to receive $^3$He therefrom, the still having an outlet for $^3$He; two adsorption pumps connected with said still outlet to receive $^3$He vapor, alternately, there being a valve or valve system connected with each pump; heater structure associated with the pumps to cause $^3$He desorption by the pumps; a condenser-collector connected with the valves to receive desorbed $^3$He, $^3$He liquid being held at a flow path outlet from the condenser-collector; and a heat exchanger connected in a flow path from the condenser-collector back to the mixing chamber.

70 Claims, 11 Drawing Sheets

OTHER PUBLICATIONS

J. Cerhold, "Dielectric Breakdown of Helium at Low Temperatures", Cryogenics 12, pp. 370–376 (11/1972).
D. Petrac and P. V. Mason, "Evaluation of Porous--Plug Liquid Separators for Space Superfluid Helium Systems", Seventh International Cryogenics Engineering Conference Proceedings (ICEC7) (IPC Press; Surrey, England; 6/1978), pp. 120–125.
D. Petrac and P. V. Mason, "Infrared Astronomical Satellite (IRAS) Superfluid Helium Tank Control", 1983 Space Helium Dewar Conference Proceedings, (University of Alabama; Huntsville, Alabama; 5/1984), pp. 164–169.
H. Nakai & M. Murakami, "Flow Phenomena of Superfluid Helium through a Porous Plug Phase Separator", Cryogenics 27, pp. 442–449 (8/1987).
Ch. Oliver, "Performance of Electrodes at the First Voltage Breakdown in Liquid Helium", IEEE Transactions on Magnetics, vol. Mag–17, pp. 2086–2088 (5/1981).

DIVERGENT FLAT PLATES

DIVERGENT FLAT PLATE & CURVED PLATE

DIVERGENT CURVED PLATES

SEGMENTED FLAT PLATE WITH DIVERGENT PORTION

FLAT PLATES WITH VARIABLE VOLTAGE & FRINGE FIELDS $V_1 > V_2 > V_3 > V_4$

CONCENTRIC CURVED PLATES

CONTINUOUSLY OPERATING 3HE-$^4$HE DILUTION REFRIGERATOR FOR SPACE FLIGHT

BACKGROUND OF THE INVENTION

This invention relates generally to dilution refrigerators, and more particularly to a continuously operating, $^3$He—$^4$He dilution refrigerator well adapted for use in space flight environment.

There is need for coolers that can operate at subkelvin ranges, in space. While $^3$He—$^4$He dilution refrigerators are usually preferred over adiabatic demagnetization refrigerators to reach temperatures from about 0.8 K down to several millikelvin in terrestrial laboratories, conventional dilution refrigerators of this type depend on gravity for their operation, and are thus not well adapted for use in space.

SUMMARY OF THE INVENTION

It is a major object of the invention to provide a $^3$He—$^4$He dilution refrigerator that meets the above needs, and thereby provides a very low temperature space as required by certain sensing devices and electronic equipment, and by scientific experiments conducted during space flights, and associated scientific equipment and devices.

Devices that would benefit substantially include, but are not limited to, bolometers which are used for sensing X-ray, infrared, submillimeter, and millimeter wavelength electromagnetic radiation. Theoretically, the sensitivity of bolometers in at least some of those applications varies as $T^{-n}$, where T is operating temperature and n is 5/2 in an optimum design. For an optimum device, the sensitivity would increase by a factor of more than 300 if the operating temperature were lowered from 1.0 K to 0.1 K while all other factors remained the same.

Another device that would benefit is the superconducting cavity stabilized oscillator (SCSO), which is currently being developed by NASA as an ultrahigh precision clock. The stability of these clocks is expected to improve substantially as the temperature is lowered below 1 K. Such clocks require highly regulated, continuous cooling, thus ruling out adiabatic demagnetization refrigerators, which are basically one-shot devices and must be recycled intermittently. Space applications of the SCSO include gravity wave detectors, global positioning systems, and very long baseline interferometry.

Also, a new class of particle detectors that require subkelvin temperatures are currently being developed. One such device is a new kind of neutrino detector. The present refrigerator would enable them to work in earth orbit and in other microgravity environments.

The advent of the space station will provide new facilities for scientific experimentation. The present refrigerator would be a useful part of those facilities, and, for example, make possible studies of $^3$He—$^4$He mixtures below the tri-critical point where the two phases may form an emulsion in a microgravity environment. Experiments in space on superfluid $^3$He, which require temperatures below 2 millikelvin, could also benefit from this refrigerator when it is used in combination with an additional stage of cooling.

Basically, the invention is embodied in the combination that includes a) an electrostatic mixing chamber containing $^3$He-rich and $^4$He-rich phases subject to separation in response to electrostatic force application, the chamber having an outlet for $^3$He that has passed through an interface between those two liquid phases to produce cooling, b) a still connected with the mixing chamber to receive $^3$He therefrom, the still having an outlet for $^3$He, c) two adsorption pumps connected with said still outlet to receive $^3$He vapor, alternately, there being a valve or valve system, or valve means, connected with each pump, d) heater means associated with the pumps to cause $^3$He desorption by the pumps, e) a condenser-collector connected with the valves to receive desorbed $^3$He, and means to hold $^3$He liquid at a flow path outlet from the condenser-collector, f) and a heat exchanger connected in a flow path from the condenser-collector back to the mixing chamber.

As will appear there are well-defined interfaces established between the liquid and gaseous phases in each of the still and condenser-collector, and a well-defined interface between two liquid phases in the mixing chamber.

It is another object of the invention to provide a porous plug at the still and within which the interface between a liquid phase mixture of $^3$He and $^4$He (which is $^4$He-rich) and a vapor phase mixture of $^3$He and $^4$He (which is $^3$He-rich) is established for holding liquid in the still, thereby allowing selective evaporation of $^3$He from the still during normal operation of the system.

A further object is the provision of electrostatic force producing means at the still that establishes a well-defined interface between liquid and vapor phases in the still, allowing selective evaporation of $^3$He from the still.

A further object is the provision of electrostatic force producing means at the condenser-collector where a well-defined liquid-vapor interface is established, the condensed liquid $^3$He being held adjacent to the entrance of a capillary at the condenser-collector. As will appear, the vapor pressure at the liquid-vapor interface provides a force that drives liquid through the capillary.

Another object is the provision of a capillary or capillaries to define a flow path (or paths) for vapor from the still to the adsorption pumps and from the adsorption pumps to the condenser-collector.

Another object is the provision of a capillary or capillaries to define a flow path (or paths) for condensed liquid between the condenser-collector and the mixing chamber, and between the mixing chamber and still. As will appear, liquid in the capillaries may be subjected to electrostatic forces, to suppress bubble formation.

A further object is to provide flow impedance or impedances in the return flow path from the condenser-collector to the mixing chamber. The flow impedance (or impedances) allows the pressure to build up in the condenser so than condensation of liquid occurs there, and helps limit the mass flow rate through the refrigerator to useful values. A further flow impedance may be provided between the mixing chamber and the still. It is placed nearer to the still than the mixing chamber so that viscous heating of the liquid in the impedance will add minimal heat to the mixing chamber. All of those impedances are located in positions such that bubble formation tends to be suppressed in the liquid throughout the refrigerator.

Yet another object is to provide the valves associated with the pump with annular seats and stoppers having ball surface portions that move toward and away from the seats in response to solenoid produced magnetic field variation. The seats may consist of soft metal, such as gold; and portions of the stopper may be magnetized, either permanently or temporarily, for solenoid actuation. This includes the case where portions of the stoppers are made of superconducting materials which are diamagnetic. The solenoid may be made of superconducting material to reduce undesired electrical heating of the coils.

Additional objects include the provision of a heat switch between the still and mixing chamber for assisting a start-up of the refrigerator; the provision of a $^3$He pot thermally coupled to the mixing chamber for assisting in start-up of the refrigerator; and the provision of means for producing electrostatic forces to position liquid at a capillary outlet from the condenser-collector, and adjustable heater means for controlling saturated vapor pressure at the liquid-vapor interface in the condenser-collector, to control the force that drives the liquid, and in turn the rate of liquid flow, through the path from the condenser-collector to the mixing chamber, and also through the path from the mixing chamber to the still.

A further prime object of this invention is to enable testing of a flight dilution refrigerator, including the three primary interfaces between different phases in the mixing chamber, still, and condenser-collector, while in earth's gravity.

These and other objects and advantages of the invention, as well as the details of an illustrative embodiment, will be more fully understood from the following specification and drawings, in which:

DRAWING DESCRIPTION

Figure 7:
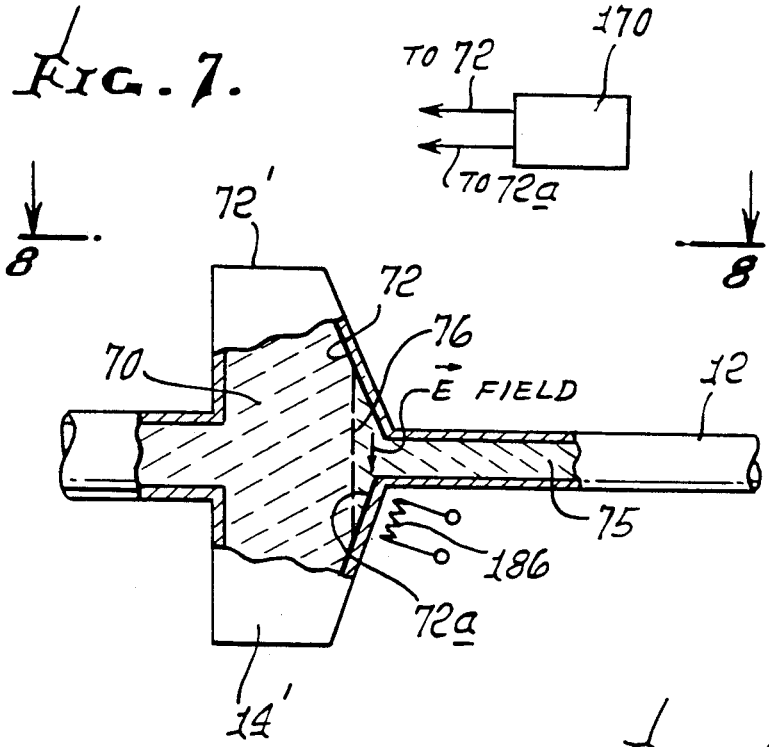
FIG. 7 is a side elevation showing an electrostatic still.
Figure 7A:
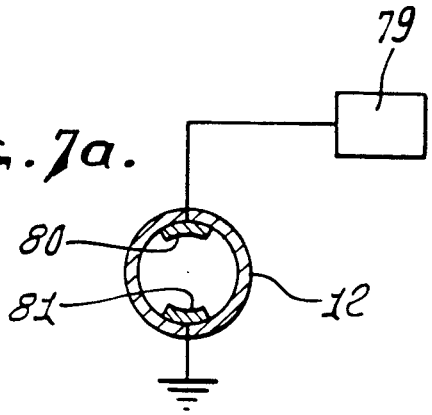
Figure 8:
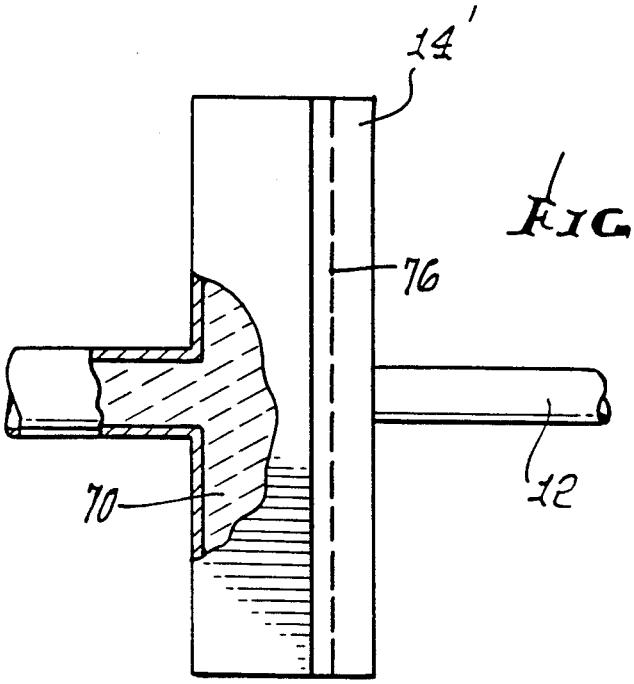
Figure 9:
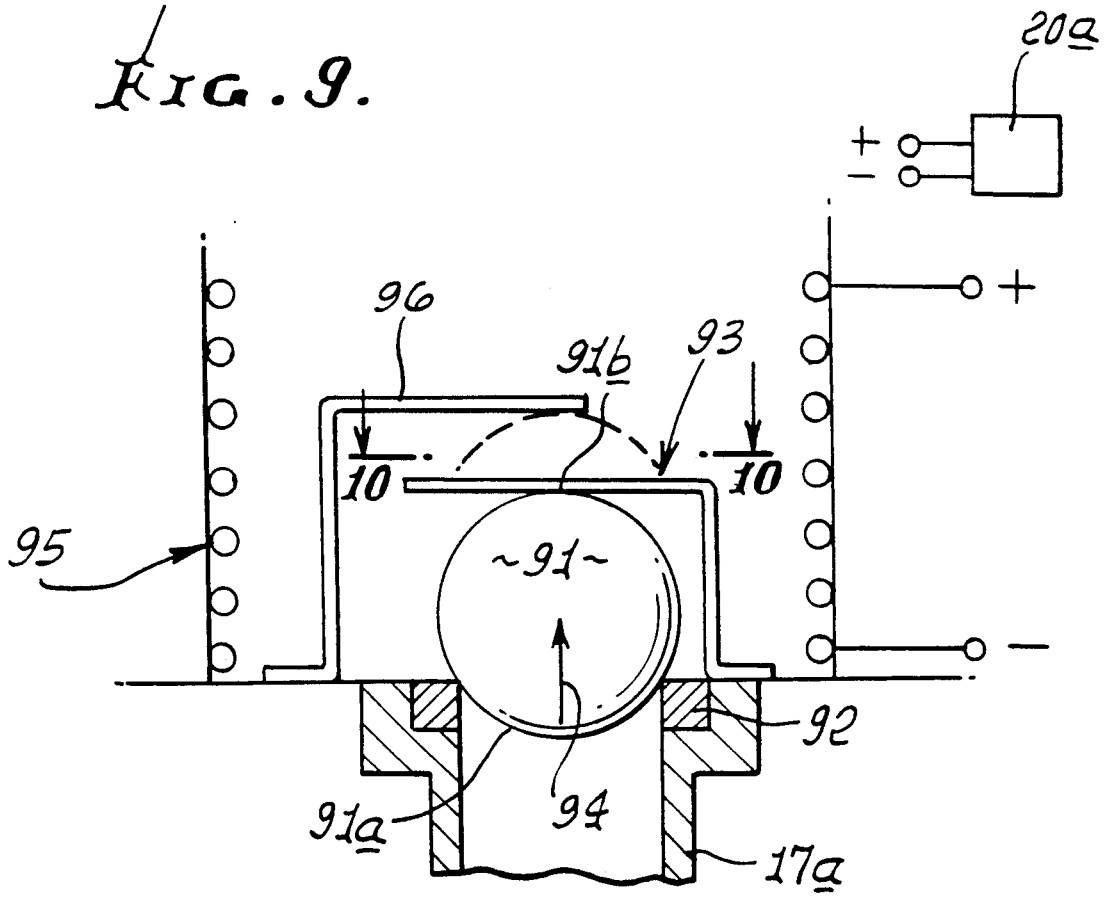
Figure 10:
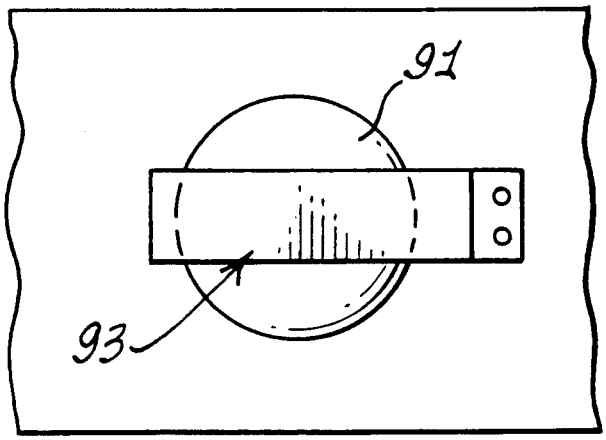
Figure 11:
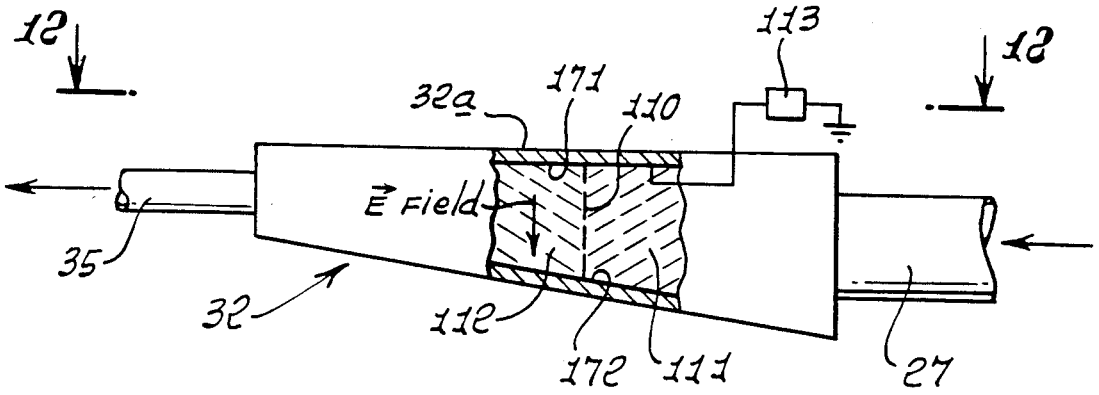

FIG. 7*a* shows a capillary cross section;

FIG. 8 is a top plan view of the FIG. 7 electrostatic still;

FIG. 9 is a section taken through a solenoid operated valve;

FIG. 10 is a plan view taken on lines 10-10 of FIG. 9;

FIG. 11 is a side elevation showing a condenser-collector; and

Figure 12:
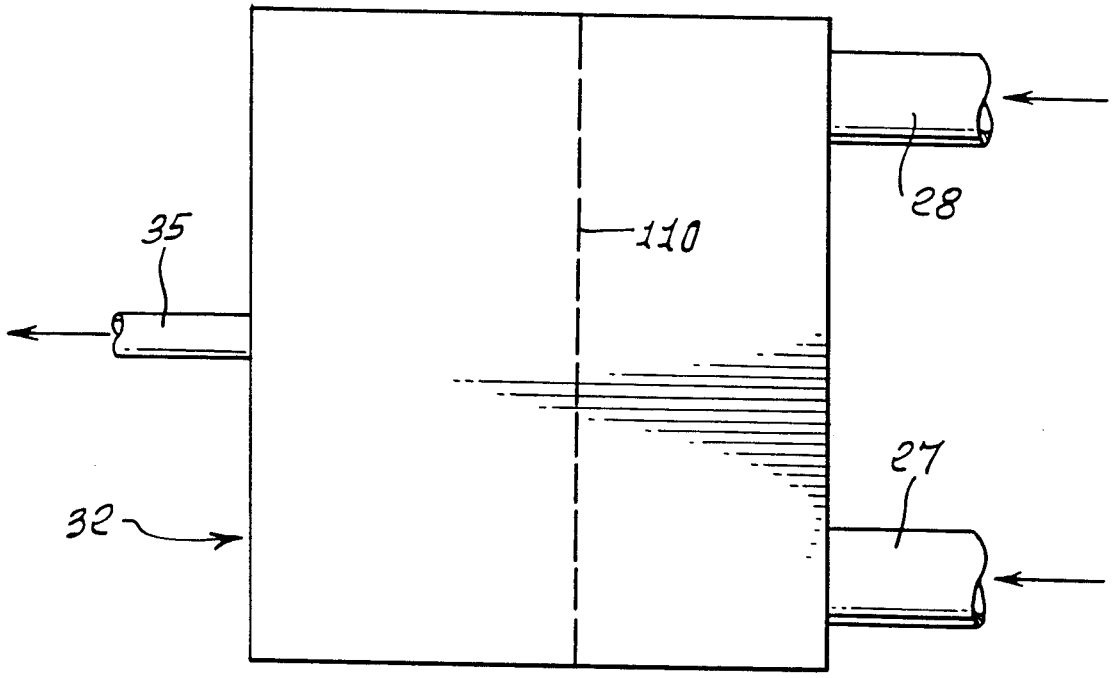
Figure 13A:
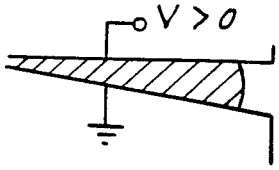
Figure 13B:
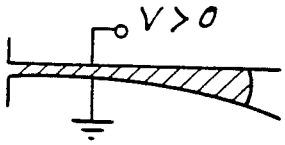
Figure 13C:
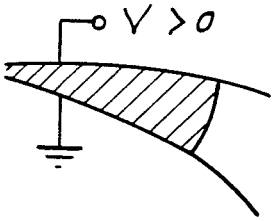
Figure 13D:
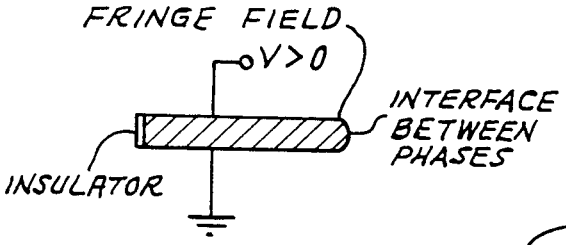
Figure 13E:
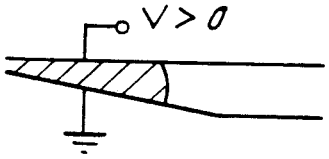
Figure 13F:
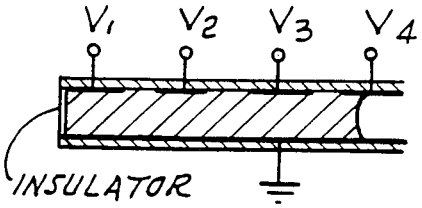
Figure 13G:
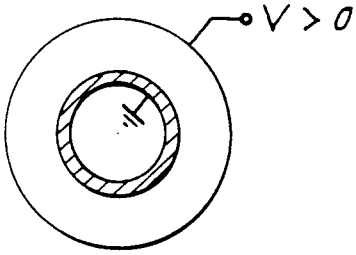
Figure 13H:
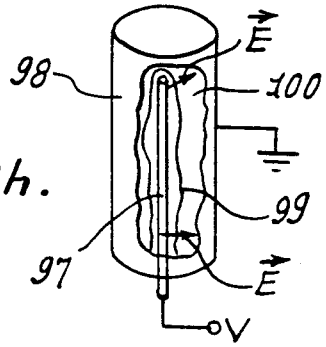
Figure 14B:
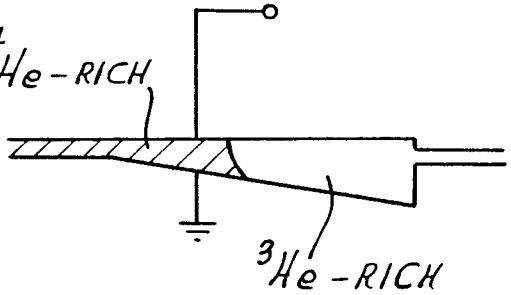
Figure 14A:
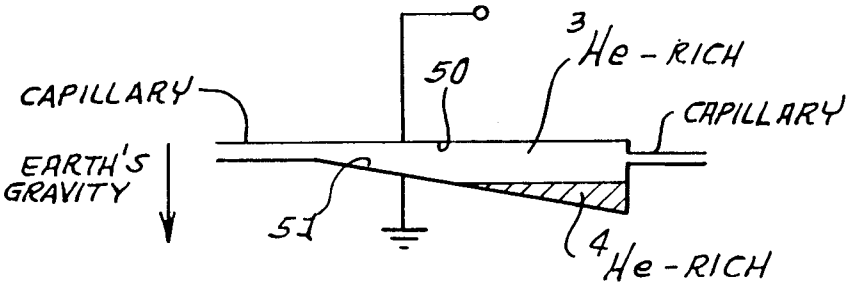
Figure 15B:
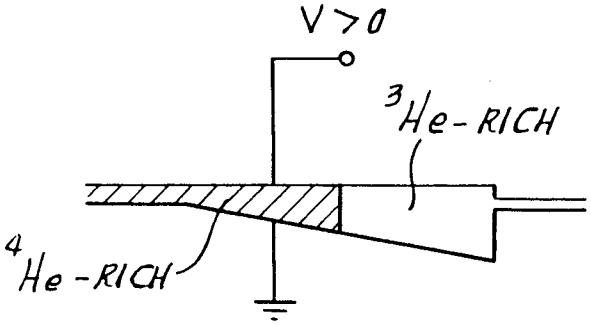
Figure 15A:
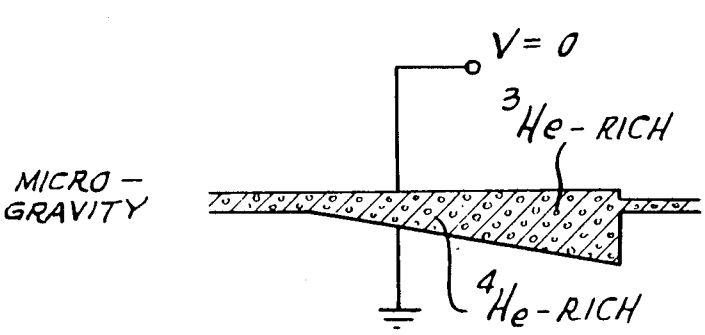
Figure 16B:
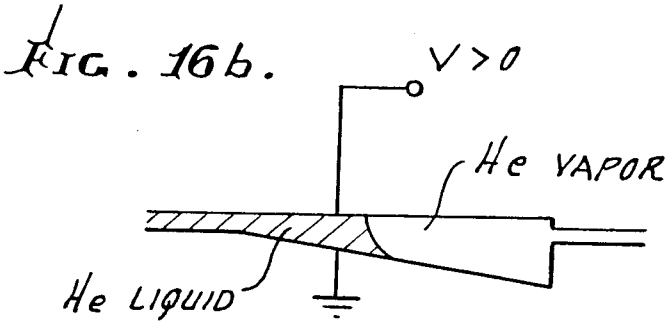
Figure 16A:
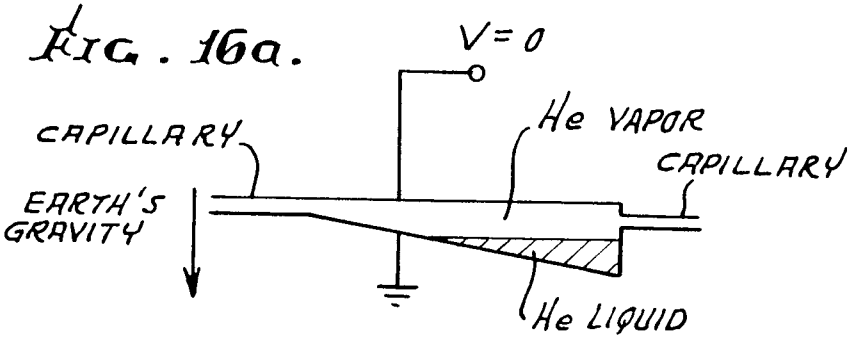
Figure 17B:
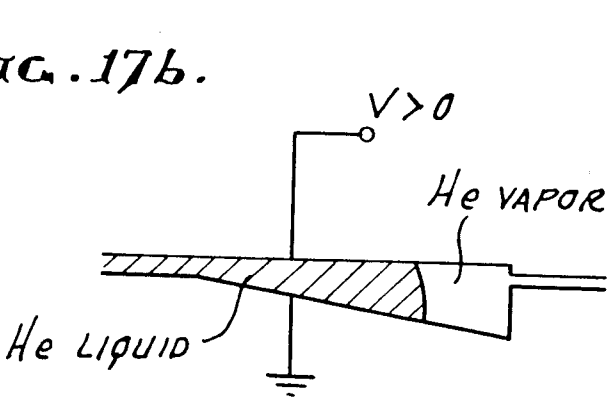
Figure 17A:
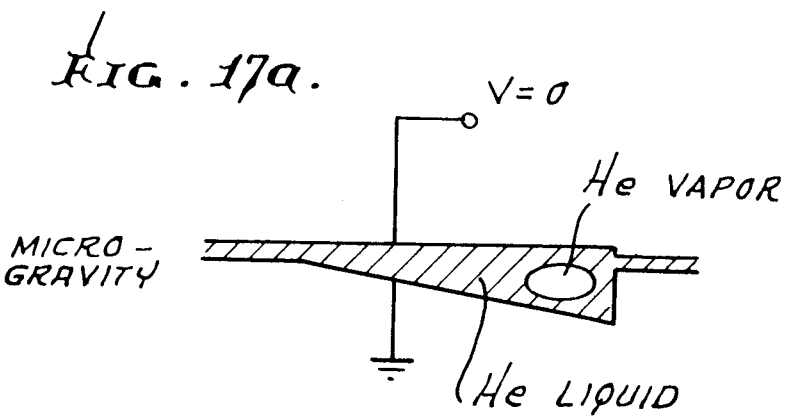
Figure 18:
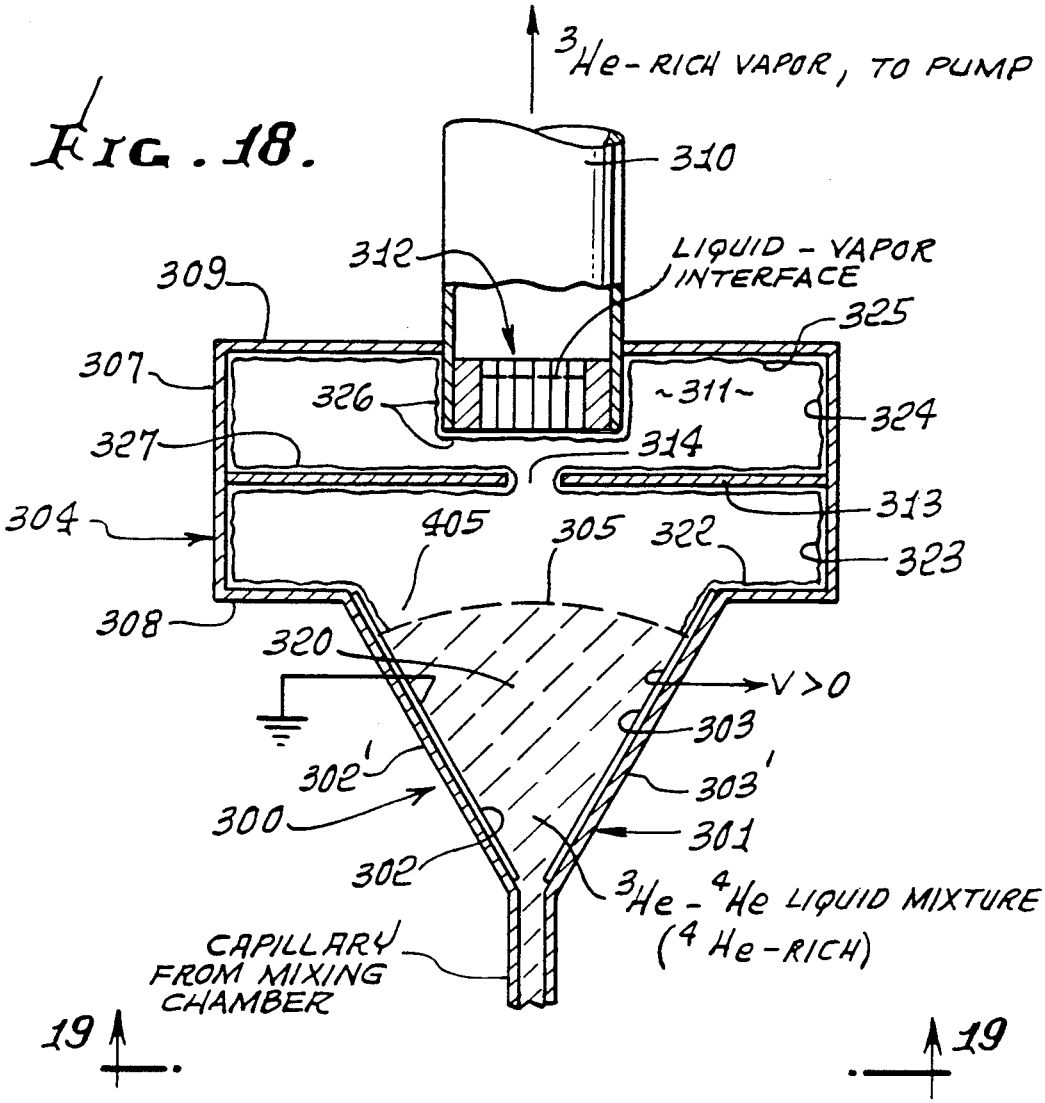
Figure 19:
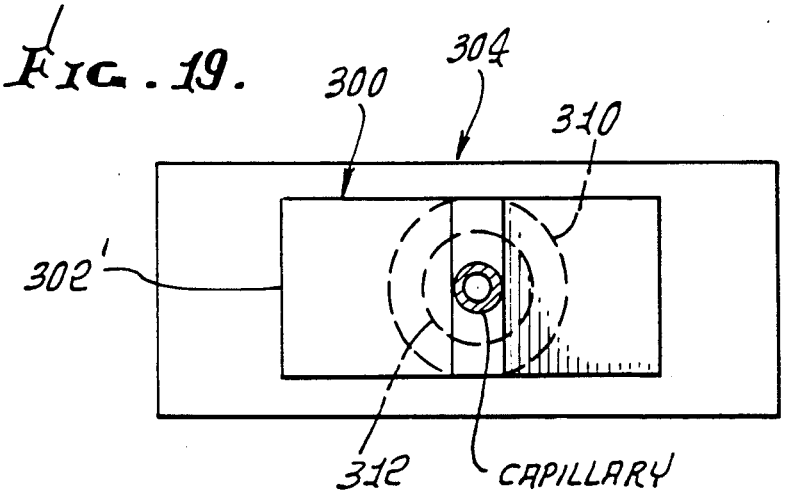

FIG. 12 is a plan view of the FIG. 11 condenser-collector;

FIGS. 13*a*–13*h* are schematic views showing various conducting plate configurations; and FIGS. 14*a* and 14*b* are schematic views showing an electrostatic mixing chamber in earth's gravity, and under zero and greater than zero voltage application, respectively;

FIGS. 15*a* and 15*b* are like FIGS. 14*a* and 14*b*, but showing conditions of the apparatus under microgravity;

FIGS. 16*a* and 16*b* are schematic views showing either an electrostatic still or an electrostatic condenser-collector, in earth's gravity, and under zero and greater than zero voltage application, respectively;

FIGS. 17*a* and 17*b* are like FIGS. 16*a* and 16*b*, but showing conditions of the apparatus under microgravity;

FIG. 18 is a elevation, in section, showing a combination porous plug and electrostatic still; and FIG. 19 is a top plan view of the FIG. 18 apparatus.

GENERAL ORGANIZATION

Figure 1:
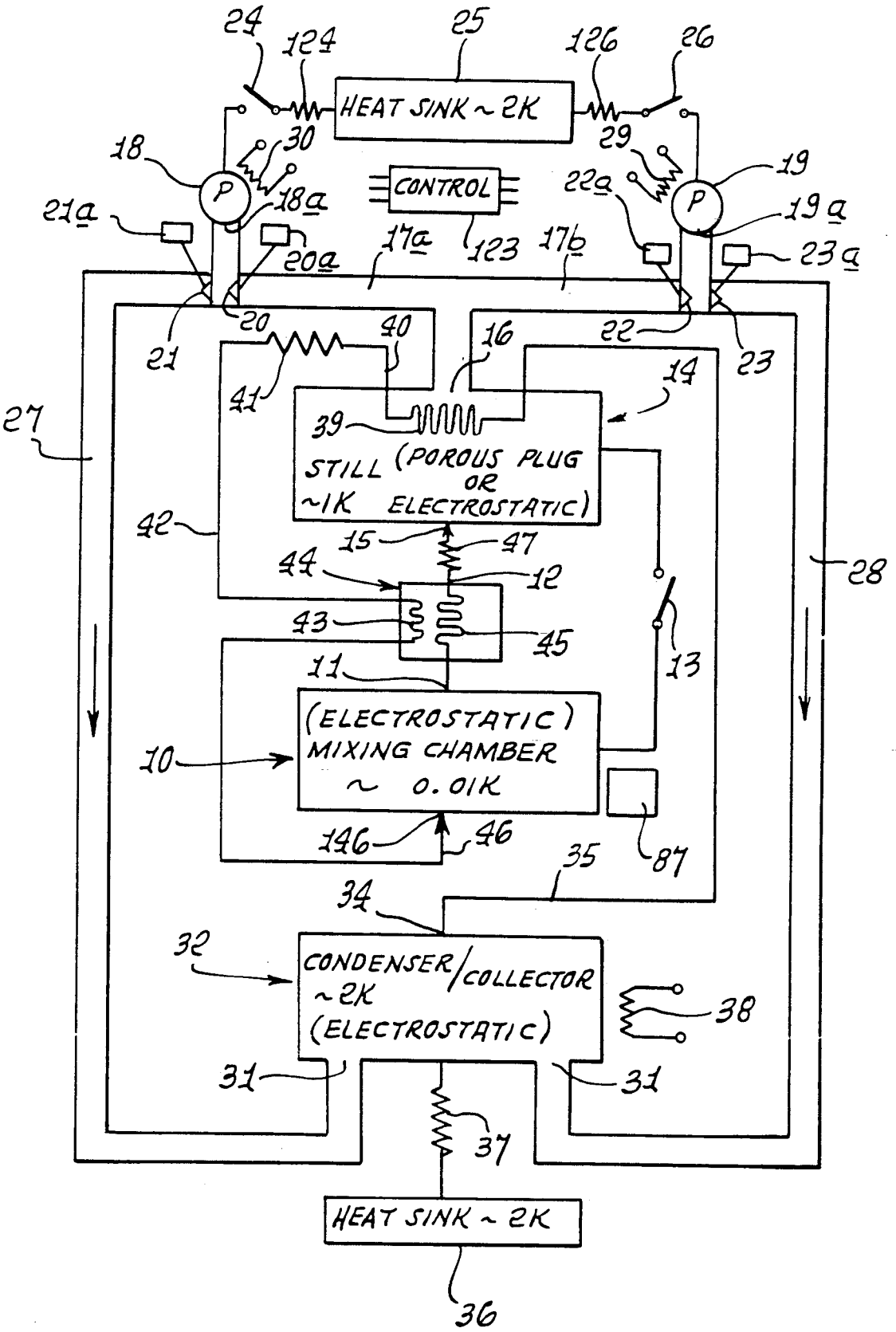
FIG. 1 is a schematic diagram of one overall system embodying the invention.

Referring to FIG. 1, an electrostatic mixing chamber is indicated at 10. It contains $^3$He-rich, and $^4$He-rich phases subject to separation in response to electrostatic force application. The chamber has an outlet at 11 for the $^3$He that has passed through an interface between these two liquid phases, to produce cooling. The mixing chamber is the coldest part of the system, during normal operation and that is where heat is absorbed from an attached load or device that is to be cooled. During steady state operation where the temperature of the mixing chamber remains constant, the entropy associated with the heat absorbed from the load plus the parasitic heat into the chamber is just equal to the entropy added to the $^3$He atoms that migrate across the interface which separates a $^3$He-rich phase from a $^4$He-rich phase in the mixing chamber. This latter quantity is called the entropy of dilution. The $^3$He passes via capillary duct 12, and a flow impedance 47, to a still 14, having an inlet at 15, and a $^3$He vapor outlet at 16. In this regard, the mixing chamber is arranged so that the $^4$He-rich phase is located closest to the still in the circuit of the fluid. The temperature of the still is maintained near 1 K so that the vapor pressure is sufficiently high for pumping the vapor. The $^3$He-$^4$He liquid is a homogeneous mixture in the still, containing about 1 or 2% $^3$He atoms. Even though the concentration of the $^3$He atoms is low in the liquid in the still, the partial vapor pressure of $^3$He is nevertheless much greater than that of $^4$He. Therefore, $^3$He atoms will be preferentially evaporated from the still when an adsorption pump causes the pressure to be reduced at the still. The preferential depletion of $^3$He atoms from the liquid in the still produces an osmotic pressure between the still and mixing chamber and in turn in the mixing chamber itself that drives a flow of $^3$He atoms across the boundary between the two liquid phases in the mixing chamber.

Two adsorption pumps 18 and 19 are connected with the still outlet 16, as via ducts 17*a* and 17*b*. The pumps are arranged in circuit parallel, and have inlets 18*a* and 19*a*. Two check valves 20 and 21 are connected with inlet 18*a*, and two check valves 22 and 23 are connected with inlet 18*b*. A control for the valves is indicated at 123, and it may, for example, control solenoid actuators 20*a*, 21*a*, 22*a* and 23*a* for the valves. The operation is such that the pumps alternately receive $^3$He vapor, for adsorption; thus, during one time interval $\Delta_1$ when valve 20 is open and L valve 21 closed, the pump 18 operates to adsorb $^3$He vapor, by virtue of connection of that pump, via closing of heat switch 24, to a heat sink 25 (say, at 2 K) through the thermal impedance 124; and alternately, during a subsequent time interval $\Delta_2$, when valve 22 is open and valve 23 is closed, the pump 19 operates to adsorb $^3$He vapor, by virtue of connection of that pump, via closing of heat switch 26, to the heat sink 25 through the thermal impedance 126. Switches 24 and 26 are also typically operated by the master control 123.

During time interval $\Delta_1$, valve 22 is closed, and valve 23 open, so that $^3$He vapor may be desorbed by pump 19 and may flow to line 28. Heat switch 26 is then open, and the pump 19 is heated as by an electrical resistance heater 29, controlled by 123. During time interval $\Delta_2$, valve 20 is closed and valve 21 open, so that $^3$He vapor may be desorbed by pump 18 and may flow to line 27. Heat switch 24 is then open, and pump 18 is heated as by electrical resistance heater 30, controlled by 123.

The thermal impedance 124 and heater 30 controlled by 123 permit the temperature of pump 18 and in turn the rate of adsorption by that pump to be regulated during time interval $\Delta_1$. During time interval $\Delta_2$ the desorption rate by pump 18 can be regulated by heater 30 controlled by 123. Similarly, pump 19 adsorption and desorption rates can be controlled with the aid of thermal impedance 126 and heater 29 and control 123.

The two return lines 27 and 28 may be regarded as in circuit parallel, and they conduct $^3$He vapor to the inlet or inlets 31 to a condenser-collector 32. That collector has an outlet at 34, i.e. at the entrance to a capillary duct 35 that returns liquid $^3$He toward the mixing chamber. Coupled to the condenser-collector chamber are a heat sink 36, via thermal impedance 37, and a heater 38 such as an electrical resistance heater, controlled at 123. The condensed liquid in the condenser-collector, seen in FIGS. 11 and 12, is held next to the entrance of a capillary by electrostatic forces in the condenser-collector, utilizing the same principles as are employed at the mixing chamber. However, now an interface is established between a liquid and vapor rather than between two liquid phases. The condenser-collector is always just partly filled with liquid, and the pressure there is that of the saturated vapor. That pressure acts on the liquid-vapor boundary and forces liquid into the capillary.

Liquid $^3$He flows through the capillary duct 35 to a heat exchanger 39 that is thermally coupled to the still. That heat exchanger may simply be a coiled capillary that is immersed in the still liquid. The returning $^3$He then moves via duct 40 to and through a flow impedance 41. In practice, that flow impedance may be a constriction near the exit of the coil heat exchanger. The liquid is then conducted by a capillary 42 to a heat exchange path or coil 43 in another heat exchanger 44, which may be of the counterflow type. The other side or path 45 in that exchanger is connected with flow link 12 between the mixing chamber and the still. In this second heat exchanger 44, the temperature of the circulating $^3$He liquid is reduced almost to that of the mixing chamber before it enters that chamber at 146 via capillary 46.

There is also a second flow impedance 47 located near the still. That location minimizes the detrimental effects on the mixing chamber due to viscous heating in the impedance.

The main purposes of the flow impedances are to enable the pressure to build up in the condenser-collector so that vapor can condense to liquid there, and to permit the pressure to drop from that of the saturated vapor of $^3$He at 2 K in the condenser-collector to the saturated vapor pressure of the 1 or 2% mixture of $^3$He in $^4$He in the still without having an excessively large mass flow. The impedances are located in such a manner that the liquid will tend not to become superheated during normal operation, thereby suppressing formation of bubbles in the capillaries and other components in the path between the exit of the condenser-collector at 34 and the entrance to the still at 15.

ADDITIONAL DESCRIPTION

Figure 2:
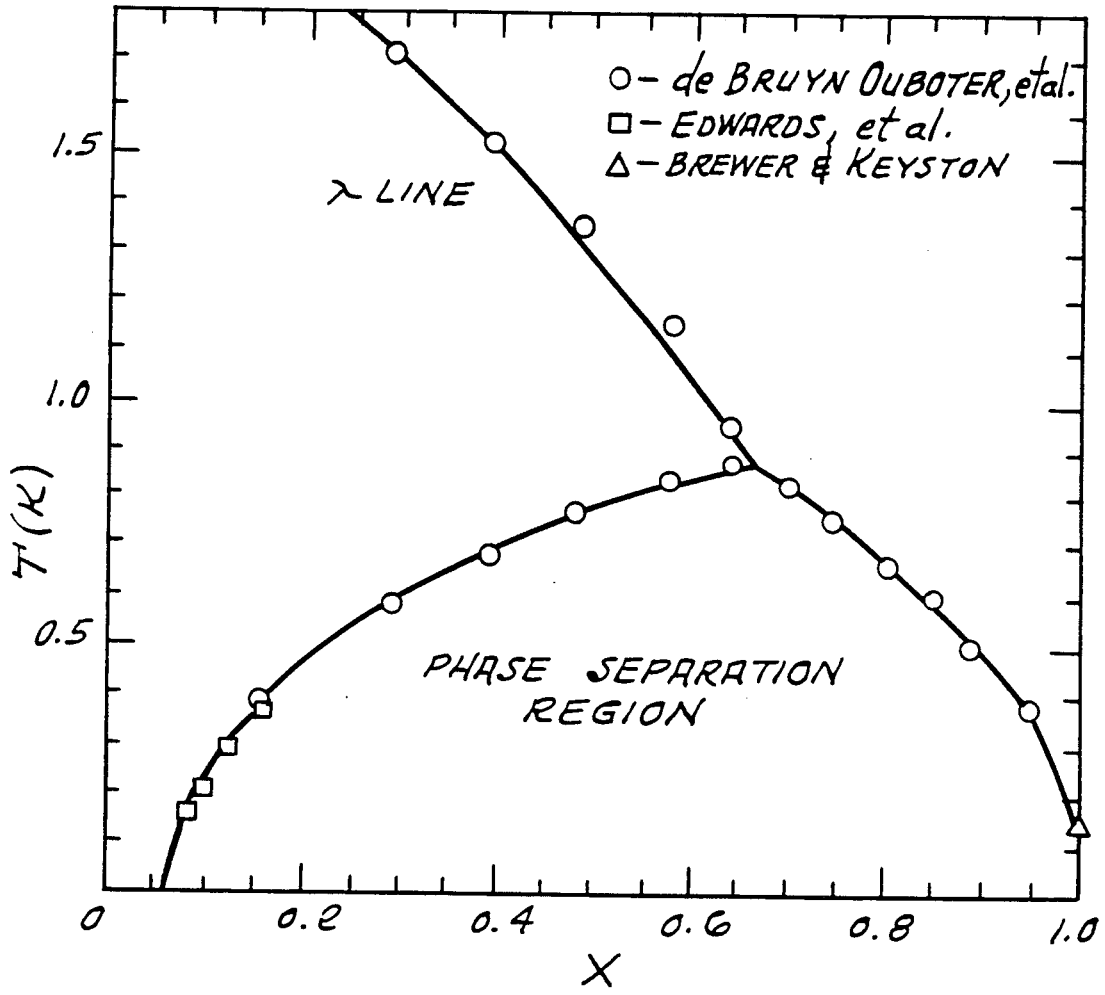
FIG. 2 is a phase diagram of $^3$He—$^4$He mixtures at saturated vapor pressure.

Establishment and control of the interface between phases in the mixing chamber is of prime importance. Methods for doing this will be described next. A phase diagram of $^3$He—$^4$He mixtures at saturated vapor pressure (see FIG. 2) shows that the liquid tends to separate into two distinct phases as the temperature is progressively lowered below a critical value near 0.86 K (the tri-critical point). For separation to occur at those low temperatures, the mole fraction of $^3$He above 0.86 K must be greater than about 6%. When separation occurs, one phase is rich in $^3$He and the other is rich in $^4$He. The $^4$He-rich phase has a higher average mass density and a higher average number density than the $^3$He-rich phase.

In earth's gravity, the less dense $^3$He-rich phase floats on top of the $^4$He-rich phase. The two phases then occupy different regions of space and have a well-defined interface between them because of gravitational effects. This is utilized in the mixing chambers of conventional dilution refrigerators that operate in terrestrial laboratories.

In the microgravity environment of space, the phases will not occupy distinct regions unless some force acts to replace gravity. In the present invention, electrical forces perform that function, as described next.

Figure 3:
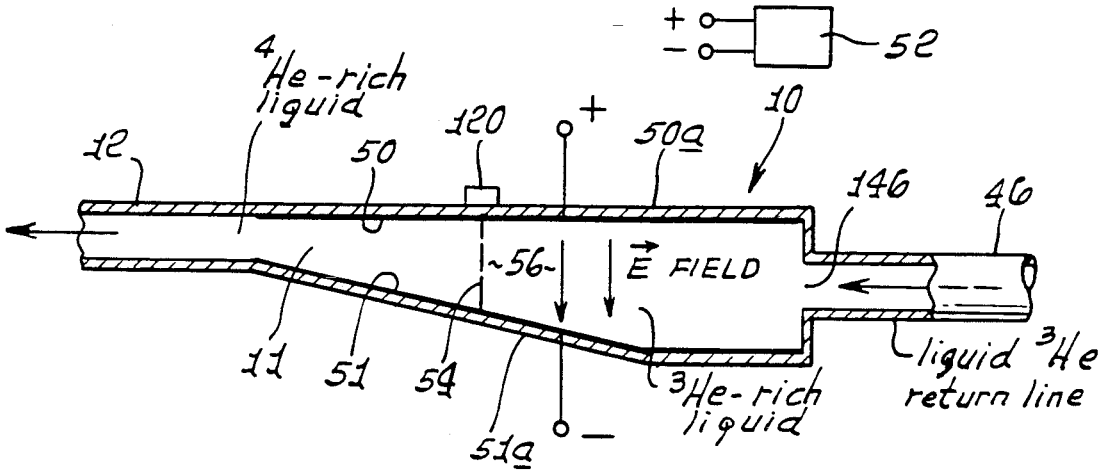
FIG. 3 is a side elevation showing one form of electrostatic mixing chamber.
Figure 4:
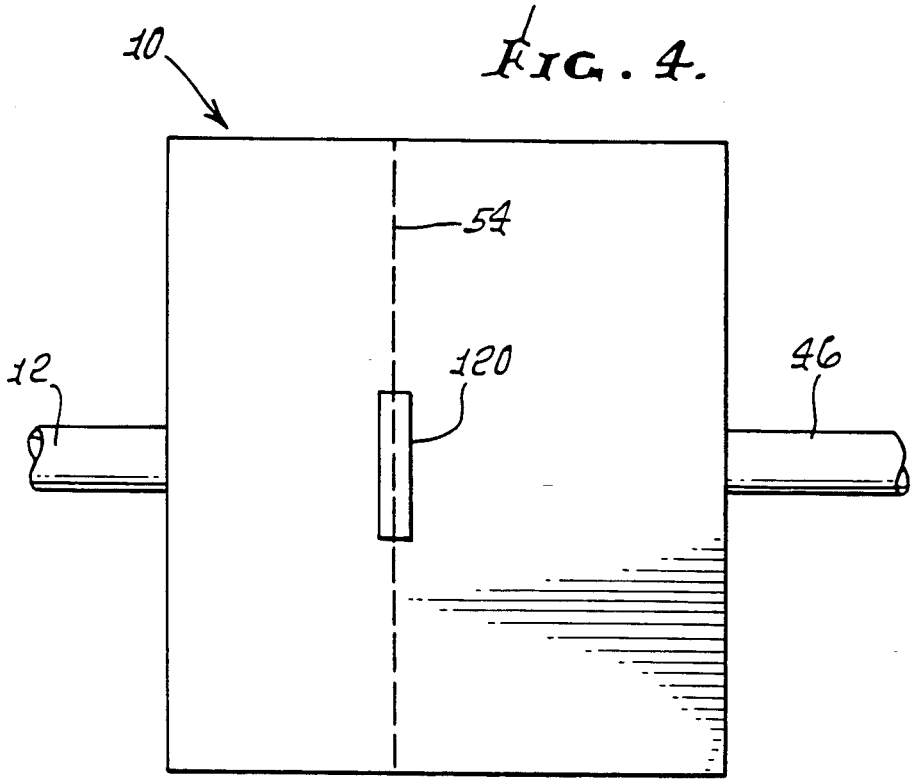
FIG. 4 is a plan view of the FIG. 3 chamber.

As seen in FIG. 3, showing a mixing chamber 10, two or more electrically conducting plates 50 and 51, in a stack, are connected to a voltage source 52 so that there is an electric field across the plates and the magnitude of the field has a gradient along the length of the plates, due for example to tapering of the distance, or gap, formed between two plates, as shown, thereby forming a wedge shaped structure. Walls 50*a* and 51*a* may be interiorly plated at 50 and 51.

In a preferred embodiment of the invention, the electric field is almost transverse to the plates (see FIG. 3). When neutral atoms such as $^3$He or $^4$He are placed in an electric field, they develop induced dipole moments which have a certain amount of free energy associated with them:

$$\text{Free Energy} = -\tfrac{1}{2}\vec{P}\cdot\vec{E}$$

where $\vec{P}$ is the polarization (i.e., total dipole moment per unit volume) and $\vec{E}$ is the electric field. The induced dipole moment per atom is directly proportional to the electric field, and the free energy per atom is therefore proportional to $E^2$. A variation in the magnitude of $\vec{E}$, and in turn of $E^2$, produces a force on the atoms urging them to move in such a way as to make the free energy of the system as low as possible. That means that when the atoms in the chamber are allowed to come to thermodynamic equilibrium, they will tend to accumulate in the region of highest electric field and be held there. $^3$He and $^4$He atoms have essentially the same atomic polarizability, so that the difference in the free energy per unit volume is determined by the number densities of atoms. Therefore, the $^4$He-rich phase, having the higher number density, will make the thermodynamic free energy lowest if that phase accumulates in the region of highest electric field. The $^3$He-rich phase tends to move to regions between the plates where the electric field is lower, and separation of the phases occurs with a well-defined interface, shown at 54, the interfacial position indicated there being that for microgravity conditions.

The space 56 between the plates has an inlet 146 and outlet 11. The mixing chamber is arranged so that the $^4$He-rich phase is located closest to the still in the circuit of the fluid. A $^3$He pot 120 may be provided for assisting in start-up of the mixing chamber, i.e. to aid in forming interface 54. Pot 120 is thermally coupled to the mixing chamber. The pot constitutes the evaporator of a separate, single-cycle $^3$He refrigerator that can reach temperatures about as low as 0.3 K.

Figure 5:
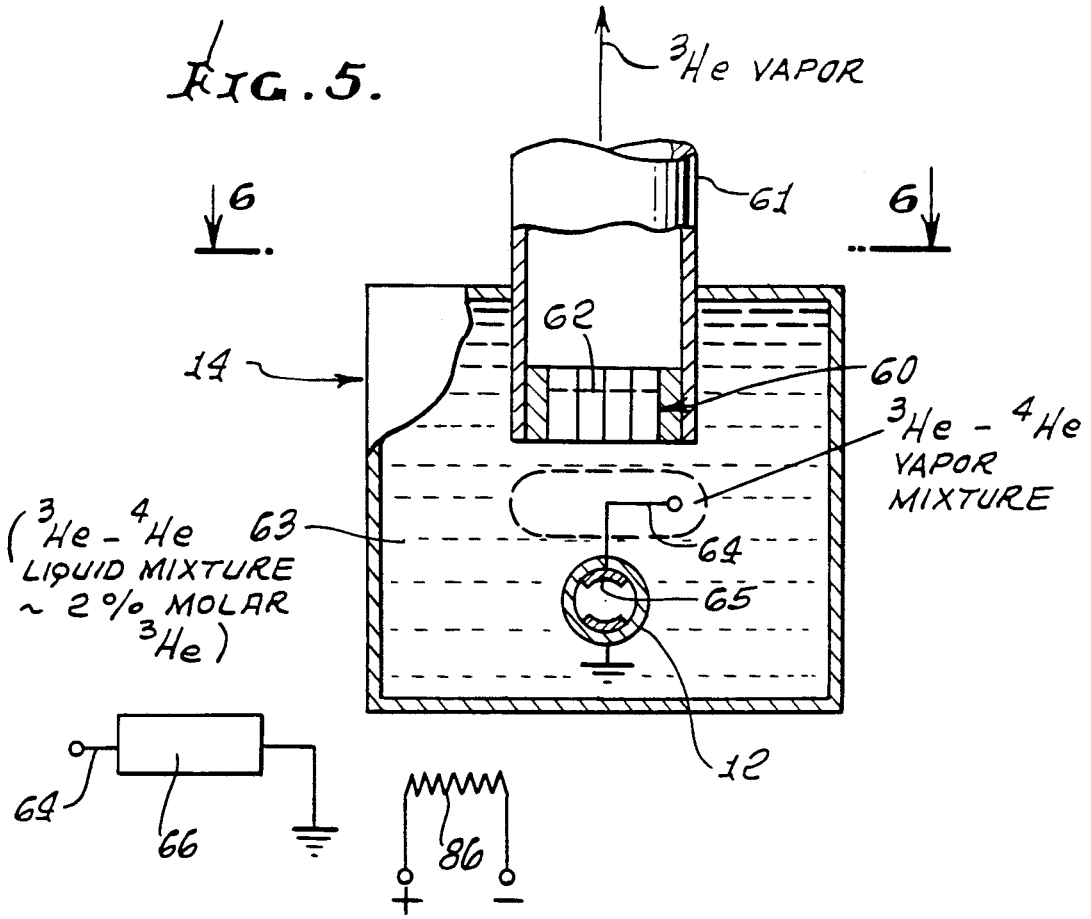
FIG. 5 is a side elevation showing one form of still, using a porous plug.
Figure 6:
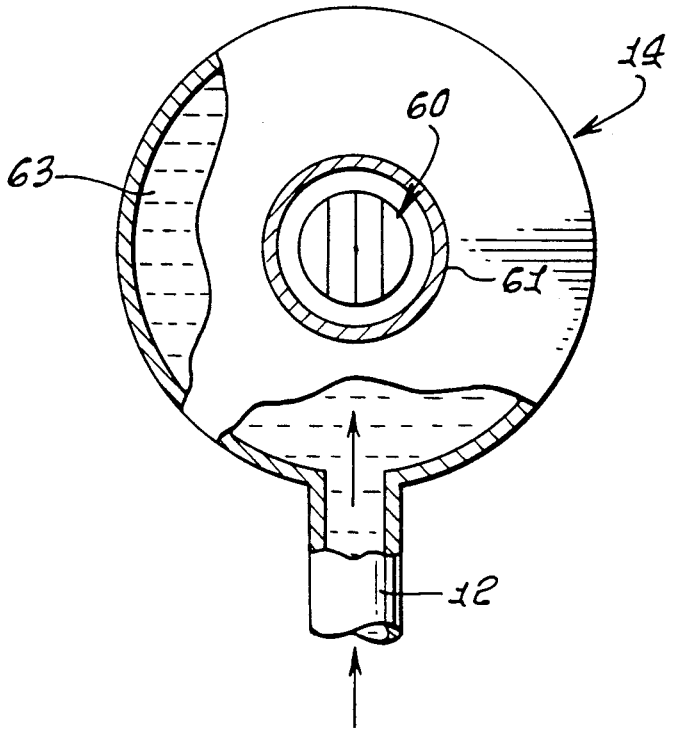
FIG. 6 is a plan view taken on lines 6-6 of FIG. 5.

A preferred embodiment of the still chamber is shown in FIGS. 5 and 6. To pump vapor from the still, it is necessary to establish a definite interface between the liquid and vapor there. This can be accomplished with the aid of a porous plug 60 made of sintered steel or sintered alumina, for example. When the pressure is reduced in the vent line 61 (corresponding to lines 17*a* and 17*b*) by a pump, an interface between the liquid and vapor is established at 62 inside the porous plug, at the inlet to line 61, and the liquid ($^3$He—$^4$He mixture, about 2% molar $^3$He) is held in the still, at 63. This is in large part due to the fountain pressure, which can be understood using a two-fluid model of superfluid helium. In the portion of the porous plug occupied by liquid, a counterflow occurs in which normal fluid flows from the interior of the still to the liquid-vapor interface inside the porous plug. The atoms evaporating at that interface act to cool it, converting part of the normal fluid to superfluid which then flows in the opposite direction, viz., from the interface back to the interior of the still. $^3$He atoms in the still become entrained with the rest of the normal fluid flow in the porous plug. This entrainment is known as the heat flush effect. When the $^3$He atoms arrive at the liquid-vapor interface, they evaporate and pass to the vent line because of their high partial vapor pressure. This arrangement therefore provides a means for selectively evaporating $^3$He atoms from the still while confining the liquid and maintaining a well-defined interface between the liquid in the still and the vapor in the pumping line. The capillary line delivering $^3$He to the still is seen at 12, and voltage is applied at 64 to its conductive inner surface 65, from voltage source 66. Lower conductive surface 165 may be connected to ground, as shown. The still itself is made of electrically insulating material. When the still is not full of liquid (the normal operating condition), the liquid coats the walls of the still and the inner surface of the porous plug. The ullage is in the interior of the still.

FIGS. 7 and 8 show a still characterized by use of an electrostatically controlled liquid-vapor interface. Note liquid return line 12, vapor at 70 in the still chamber 14'; metal coated inner wall 72 of the still chamber, the chamber wall 72' itself typically being insulative, i.e. plexiglass, for example. (While the term "metal coated inner wall" is used here, this term may refer to a metal film coating or coatings, or to a metal plate or plates. The outer wall would typically be insulative.) A voltage is applied between metal plated walls 72 and 72*a* of the still chamber, to produce an $\bar{E}$ field therebetween. See voltage application means 170. A liquid $^3$He—$^4$He mixture appears at 75, and has a surface at 76, adjacent to the vapor region.

In a preferred embodiment of the invention, the capillaries (ducts) are of electrostatic type, in which the inner walls of an electrically insulating tube are partly coated with a metal film, in the cross section of a capillary in FIG. 7*a*. A voltage source 79 connected across the metallized regions 80 and 81 establishes an electric field in the interior of the capillary, transverse to its length. The purpose of that field is to suppress the formation of bubbles in the capillary. Bubbles could possibly form a vapor lock that would stop the flow of liquid.

The cooling power of the refrigerator can be controlled and matched to a heat load for steady state operation by: (1) adjusting the temperature of adsorption pumps by using and adjusting electrical heaters 29 and 30, and (2) adjusting the temperature of the liquid in the condenser-collector 32, and in turn the vapor pressure therein, through the use of an adjustable electrical heater 38 and a thermal impedance link 37 to the heat sink, and (3) adjusting the temperature of the still with an adjustable heater, to control rate of evaporation. See heater 86, in FIG. 5 and heater 186 in FIG. 7.

The heat switch 13 between the mixing chamber and still is included for starting up the refrigerator. At start-up, the heat switch is closed. Pumping on the still reduces the temperature of the still and of the mixing chamber coupled to the still through the heat switch. The still is the coldest part of the refrigerator at this stage of the operation. When the temperature of the still has reached about 1.0 K or 0.9 K, somewhat above the tri-critical temperature so that phase separation cannot yet occur in the liquid, the heat switch is opened. Then pumping is started on the liquid in an auxiliary $^3$He pot 120 that is thermally coupled to the mixing chamber. This can cool the mixing chamber to a temperature low enough for phase separation to occur there, as in normal operation of the refrigerator, while the still is maintained at temperatures high enough to avoid phase separation of the liquid mixture in the still at all times. The load to be cooled, which appears at 87, is thermally coupled to 10.

The path of vapor flow is controlled at 20–23 by miniature solenoid valves especially designed and adapted for this application (see FIGS. 9 and 10). When for example the valve 20 is closed, the stopper or gate 91 consisting of a hard metal sphere (or other body having a spherical surface portion at 91*a*) is seated in a ring seat 92 made of soft metal such as gold. A flat spring 93 attached to the stopper at 91*b* holds it closed. In one embodiment of the valve, the stopper is made of ALNICO V, magnetized in the direction shown, by arrow 94, in the figure. A superconducting solenoid coil 95 is positioned so that when an electrical current passes through it, its magnetic field can pull the magnetized sphere up and open the valve. Because the solenoid is made of superconductive material, it will not generate Joule heat that could degrade the performance of the refrigerator. Passing current through the solenoid in the opposite direction tends to close the valve tighter than the spring acting alone. This can be utilized to improve seating of the stopper as the soft metal ring wears away due to repeated use. A metal bracket 96 limits the opening travel of the stopper.

Instead of using a porous plug to confine the liquid and establish a liquid-vapor interface in the still, a stack of two or more electrostatic plates could be used for that purpose, as shown and described above.

Instead of employing divergent flat plates in the mixing chamber, the condenser-collector, or the still arrangement shown in FIGS. 7 and 8, the electric field gradient therein could be provided by curved plates, or by the fringing fields of parallel plates, or by a set of neighboring parallel plates capacitors having different voltages across them.

Instead of the single solenoid and the stopper shown in FIGS. 9 and 10, two solenoids could be used with a stopper consisting of a soft iron ball. The solenoids would then be positioned above and below the gate in such a way that one solenoid would pull the stopper away from the seat, and the other solenoid would pull it shut.

Instead of the single solenoid and the stopper shown in FIGS. 9 and 10, two solenoids could be used with a stopper consisting of a superconducting material that is diamagnetic. The solenoids would then be positioned above and below the gate in such a way that one solenoid would push the stopper away from the seat, and the other would push it shut.

The present invention is believed to embody the first complete system for a continuously operating $^3$He—$^4$He dilution refrigerator with circulating $^3$He that can operate in a microgravity environment. Of prime importance in this regard are methods of confining the liquid helium in the desired locations while establishing the three well-defined interfaces between different phases in the mixing chamber, still, and condenser-collector, and at the same time permitting the necessary circulation of $^3$He.

A new and highly valuable feature of this invention is its capability for operation in a horizontal orientation in earths' gravity at least when the porous plug version of the still is used. Furthermore, it can be arranged so that in the horizontal orientation all of the mechanisms for localizing the liquid and vapor phases can be tested on a flight version of the refrigerator, thereby increasing its reliability.

Dielectric breakdown limits the voltage that can be usefully applied across conductors throughout the refrigerator. The electric field strengths required for positioning the two liquid phases in the mixing chamber and the liquid and vapor phases in the condenser-collector can be achieved with due care in either microgravity or for a horizontally oriented refrigerator in earth's gravity. The electric field strengths required for positioning the liquid and vapor in the electrostatic still can also be achieved without dielectric breakdown with due care in microgravity. Dielectric breakdown is a severe problem even for a horizontally oriented refrigerator in earth's gravity. The porous plug still is particularly advantageous in that with due care it can establish the required phase separation with well-defined liquid-vapor interface in earth's gravity or in microgravity.

The use of a porous plug to confine $^3$He—$^4$He liquid mixtures, while permitting circulation of $^3$He, as shown in FIGS. 5 and 6 where it is used in the still, not only has advantages for flight dilution refrigerators as described in the previous paragraph, but it can also be used to advantage in other dilution refrigerators for operation on earth. One of the major benefits in either the flight model or the terrestrial model is that a properly designed porous plug can prevent superfluid $^4$He from creeping into the vent pipe from the still. In conventional dilution refrigerators, suppression of that creep is accomplished with the aid of a more complicated mechanism involving the combined action of a heater that dries off the vent pipe and a system of baffles that prevents the $^4$He evaporated from the film from being vented. If a creeping film entered the vent pipe, it would evaporate there and cause an excessive amount of $^4$He to be circulated with the $^3$He. This would degrade the performance of the refrigerator.

The incorporation of electric fields in the capillaries to inhibit formation of large bubbles that could produce vapor locks there is of great advantage toward promoting predictable and trouble-free operation of the refrigerator under microgravity conditions. Furthermore, those electric fields produce an effective pressure that can be used to help clear a vapor lock so that the refrigerator can be restarted in a space environment if necessary.

The solenoid valves that operate at low temperatures incorporate a construction having advantages that include suitability for miniaturization, use of a superconducting solenoid to eliminate Joule heating, and use of a sphere surface for the valve stopper. The latter presents a circular perimeter to the soft metal seat in which it seats when closed, and thereby simplifies the problem of obtaining a good seal without requiring highly accurate alignment of the parts. (A conical stopper, if slightly tilted, would present an elliptical perimeter to the circular boundary in which it seats when closed, which would interfere with good seating).

FIGS. 11 and 12 show a condenser-collector 32, having a chamber 32*a* within which an interface 110 is defined between $^3$He return vapor 111, and $^3$He liquid at 112, at about 2.0 K. See return vapor ducts 27 and 28, and $^3$He liquid return pipe 35. As before, the inner wall of the chamber 32*a* may be metallized to form a plate 171 and electrically charged, as by voltage source 113. A grounded plate on the opposite wall is seen at 172, and $\vec{E}$ field is produced between 171 and 172.

Either direct current or alternating current voltages may be applied across conductors in the mixing chamber, condenser-collector, electrostatic still, or electrostatic capillaries for the purpose of holding the liquids in certain locations while excluding vapor from those locations, as required for operation of the refrigerator. Alternating current voltages reduce the disruptive effects of any free electric charges that may be present in the liquids or at their boundaries with each other or their boundaries with the vapor.

FIGS. 13*a*–13*g* show various conducting plate configurations usable in the above described mixing chamber, still and condenser-collector elements, and illustrating the interface between two helium phases in microgravity. In each of these configurations as shown, the shaded region (or regions) inside the chamber and capillaries corresponds to the helium phase with a higher dielectric constant; and the unshaded region corresponds to the helium phase with the lower dielectric constant.

Further, in the mixing chamber, the $^4$He-rich phase has a higher dielectric constant than the $^3$He-rich phase.

In the still, the liquid helium phase has a higher dielectric constant than the vapor phase.

In the condenser-collector, the liquid helium phase has a higher dielectric constant than the vapor phase.

Under microgravity conditions, the interface is determined approximately by the condition $E^2$=constant (the relative dielectric constant of helium$\approx$1, so the electric displacement $$\vec{D}=E_oE_r\vec{E}\approx E_o\vec{E}.)$$

Further, each configuration 13*a*–13*g* may be the cross-section of a plate configuration that is uniform in the direction perpendicular to the plane of the paper. Each of the configurations 13*a*–13*f* may be half of the cross-section of a plate configuration with cylindrical symmetry about an axis at the left hand edge of the plates. Each of the configurations 13a–13f may be half of the cross-section of a plate configuration with cylindrical symmetry about an axis at the right hand edge of the plates.

FIG. 13g illustrates for example the cross-section of a plate configuration with spherical symmetry about the center of the two plates.

FIG. 13h illustrates, in perspective, a conductive rod or tube 97 projecting axially in a conductive cylinder 98, and forming a mixing chamber (or electrostatic still or condenser-collector). Voltage V is applied to the rod or tube, and the cylinder is grounded. $^4$He-rich liquid collects about the rod or tube as seen at 99, and $^3$He-rich liquid is in the space 100 about the $^4$He-rich liquid.

FIG. 14a shows the location of $^4$He-rich liquid in a wedge-shaped electrostatic mixing chamber, in earth's gravity, with zero voltage applied to plates 50 and 51 (as referred to in FIG. 3). FIG. 14b is like FIG. 14a, but shows the $^4$He-rich liquid position when voltage>0 is applied. FIG. 15a is like FIG. 14a, but shows a mixture of $^4$He-rich and $^3$He-rich liquids, in mixed state, in microgravity; and FIG. 15b is like FIG. 14b, but showing $^4$He-rich liquid position in microgravity.

FIGS. 16a and 16b correspond to FIGS. 14a and 14b, but for an electrostatic still (as in FIGS. 7 and 8) or for an electrostatic condenser-collector (as in FIGS. 11 and 12); and FIGS. 17a and 17b correspond to FIGS. 15a and 15b, but for an electrostatic still, or for an electrostatic condenser-collector.

In FIGS. 18 and 19, a still lower chamber 300 has a downwardly convergent lower portion 301, defined by two conductive plates 302 and 303 on insulated walls 302' and 303'. An upper chamber 304 of the still opens downwardly at 405 to the interior of lower portion 301. See also liquid vapor interface 305. Chamber 304 has side walls 307, bottom wall 308 and top wall 309, all of which are insulative. A vent pipe 310 projects centrally downwardly into the upper interior 311 of chamber 304; and a porous plug 312 is supported in the lower extent of pipe 310, as shown. Note also a thin plate 313 extending transversely within the upper chamber 304, and forming a constricted opening 314 below the plug.

When voltage V is applied to plate 303, and plate 302 is grounded, an $\bar{E}$ field is formed between those plates, and the $^3$He-$^4$He ($^4$He rich) mixture forms at 320, between the plates. $^3$He—$^4$He vapor mix ($^3$He rich) fills the upper chamber interior 311, and a film of $^3$He—$^4$He ($^4$He-rich) liquid travels upwardly at 322–326 on the insulated walls, to access the porous plug. The plug functions as described above, in conjunction with the adsorber pumps to pump $^3$He vapor out the vent pipe.

Plate 313 functions as a film flow controller. Note the film 327 that also forms on plate 313.

It will be understood that throughout this application, including the claims, the term "electrostatic" refers to either DC or AC voltage conditions.

The heat sinks could be cold plates cooled by liquid helium stored in a cryostat, or cold plates cooled by other stages of refrigerators, for example.

The heat switches could be mechanical switches or gas-gap switches, for example.

On a free-flying spacecraft, background accelerations can be in the microgravity range. However, on the space shuttle, background disturbances may typically produce adverse accelerations in the milligravity range. It is useful to design a dilution refrigerator, at least for testing purposes, so that it could operate under such adverse accelerations in the shuttle. This background acceleration level helps determine the voltages that should be applied across the conducting plates in the mixing chamber, electrostatic condenser-collector, or electrostatic still. The dimensions and geometry of the chambers also help determine the required voltages.

In a useful design for any of these three chambers, the gap between the electrically conducting flat plates may be about 0.5 mm at one end of the chamber and increase to about 3.0 mm at the other end, the distance from one end of the plates to the other being about 3.0 cm. For space shuttle operation of the dilution refrigerator, the required positioning forces (which would be sufficient to counteract milligravity adverse accelerations) can be provided, for the stated geometry, by applying voltages of about 150 to 500 V d.c. or a.c.(r.m.s.) across the plates. For a dilution refrigerator oriented horizontally in earth's gravity, so that gravity acts almost perpendicular to the broad faces of the plates in each of the chambers, the voltages applied in the mixing chamber should be about 1,000 to 10,000 V d.c. or a.c.(r.m.s.). In this case, the voltage in the condenser-collector should be kept as low as possible, to avoid arcing, while producing the required orientation of the liquid-vapor interface there. It may not be possible to apply voltages high enough to produce the required orientation of the liquid-vapor interface in the electrostatic still in earth's gravity, without arcing, because of the low vapor pressure in the still. This problem was mentioned earlier in this description of a dilution refrigerator for space flight.

Referring again to FIGS. 9 and 10 and the description thereof, the valve seat may be regarded as consisting of relatively soft material, such as soft metal selected from the group consisting of gold, gold alloy, indium, indium alloy, silver, silver alloy, platinum, platinum alloy.

The stopper surface portion engaging the seat may be regarded as consisting of relatively hard material, such as sapphire, alnico, or a hard metal selected from the group consisting of steel and steel alloys.

I claim:

1. In a dilution refrigerator, the combination comprising a) an electrostatic mixing chamber containing $^3$He-rich and $^4$He-rich phases subject to separation in response to electrostatic force application, the chamber having an outlet for $^3$He that has passed through an interface between those two liquid phases to produce cooling, b) a still connected with the mixing chamber to receive $^3$He therefrom, the still having an outlet for $^3$He, c) two adsorption pumps connected with said still outlet to receive $^3$He vapor, alternately, there being valve means connected with each pump, d) heater means associated with the pumps to cause $^3$He desorption by the pumps, e) a condenser-collector connected with the valves to receive desorbed $^3$He, and means to hold $^3$He liquid at a flow path outlet from the condenser-collector, f) and a heat exchanger connected in a flow path from the condenser-collector back to the mixing chamber.

2. The combination of claim 1 wherein there are well-defined interfaces established between the liquid and gaseous phases in each of the still and condenser-collector, and a well-defined interface between two liquid phases in the mixing chamber.

3. The combination of claim 1 including a porous plug at the still and within which the interface between a liquid phase mixture of $^3He$ and $^4He$ (which is $^4He$-rich) and a vapor phase mixture of $^3He$ and $^4He$ (which is $^3He$-rich) is established for holding liquid in the still, thereby allowing selective evaporation of $^3He$ from the still during normal operation of the system.

4. The combination of claim 3 including an electrostatic force producing means that establishes a well-defined liquid-vapor interface inside the still itself, and in addition to the liquid-vapor interface formed inside the porous plug.

5. The combination of claim 4 including a means for varying the electric field at the liquid-vapor interface inside the still to control the rate at which liquid flows as a film on the still walls from that interface to the porous plug, or when the electric field in the still is reduced to low enough values, allowing the bulk liquid in the still to be adjacent to the inner surface of the porous plug, as in operating with a porous plug alone.

6. The combination of claim 5 including means forming a constriction in a wall or walls of the still at a location such that when bulk helium liquid is confined to part of the still electrostatically, a flow path of the film is provided to extend from the liquid-vapor boundary inside the still to the inner surface of the plug including that constricted perimeter, to increase the control range of film flow rate to the porous plug.

7. The combination of claim 1 including an electrostatic force producing means at the still that establishes a well-defined interface between liquid and vapor phases in the still, allowing selective evaporation of $^3He$ from the still.

8. The combination of claim 7 wherein the electrostatic force producing means at the still includes diverging conducting elements, which are maintained at different electrical potentials.

9. The combination of claim 8 wherein said elements are curved plates.

10. The combination of claim 8 wherein said elements are flat plates.

11. The combination of claim 8 wherein at least one of said elements has a flat plate portion.

12. The combination of claim 7 wherein the electrostatic force producing means at the still includes curved conductors having different radii of curvature, and which are maintained at different electrical potentials.

13. The combination of claim 7 wherein the electrostatic force producing means at the still includes electrically charged conductors forming electrical fields near the edges of conductors and at different electrical potentials.

14. The combination of claim 1 wherein said flow path is defined by a capillary or capillaries, the condensed liquid $^3He$ being held adjacent to the entrance of a capillary at the condenser-collector.

15. The combination of claim 14 including means to subject liquid in the capillaries to electrostatic forces acting to suppress bubble formation in the flow path.

16. The combination of claim 1 including means to be cooled, thermally coupled to the mixing chamber.

17. The combination of claim 1 wherein the flow path passes through a heat exchanger at the still.

18. The combination of claim 17 including a first flow impedance in the flow paths between the first heat exchanger and the mixing chamber, and positioned upstream of a second heat exchanger, that is thermally coupled to the flow path between the mixing chamber and the still.

19. The combination of claim 18 including a second flow impedance in the flow path between the mixing chamber and still, and positioned downstream of the second heat exchanger.

20. The combination of claim 17 wherein the flow path passes through a heat exchanger thermally coupled to a flow path that passes $^3He$ from the mixing chamber to the still.

21. The combination of claim 1 wherein the flow path passes through a flow impedance.

22. The combination of claim 1 wherein a flow path or flow paths between selected of the a) through f) elements is or are defined by a capillary or capillaries.

23. The combination of claim 22 including an impedance or impedances in said flow path or flow paths.

24. The combination of claim 1 wherein said valve means comprises valves that include annular seats and stoppers having ball surface portions that move toward and away from the seats in response to solenoid produced magnetic field variation.

25. The combination of claim 24 including a spring to assist stopper movement in at least one direction.

26. The combination of claim 25 wherein the seats consist of a relatively soft material.

27. The combination of claim 26 wherein said soft material is a soft metal selected from the group that consists of gold, gold alloy, indium, indium alloy, silver, silver alloy, platinum and platinum alloy.

28. The combination of claim 25 wherein portions of the stoppers are magnetized and have a permanent magnetic moment.

29. The combination of claim 25 wherein portions of the stoppers consist of ferromagnetic material.

30. The combination of claim 25 wherein portions of the stoppers consist of superconducting material that is diamagnetic.

31. The combination of claim 25 wherein solenoid means is provided to consist of superconducting material to reduce resistive heating of the solenoid means windings.

32. The combination of claim 25 wherein the ball surface portions of the stoppers are made of relatively hard material.

33. The combination of claim 32 wherein said hard material is selected from the group consisting of i) steel
ii) steel alloy
iii) alnico
iv) sapphire 34. The combination of claim 24 wherein the seats consist of a relatively soft material.

35. The combination of claim 34 wherein said soft material is a soft metal selected from the group that consists of gold, gold alloy, indium, indium alloy, silver, silver alloy, platinum and platinum alloy.

36. The combination of claim 24 wherein portions of the stoppers are magnetized and have a permanent magnetic moment.

37. The combination of claim 24 wherein portions of the stoppers consist of ferromagnetic material.

38. The combination of claim 24 wherein portions of the stoppers consist of superconducting material that is diamagnetic.

39. The combination of claim 24 wherein solenoid means is provided to consist of superconducting material to reduce resistive heating of the solenoid means windings.

40. The combination of claim 24 wherein said ball surface portions of the stoppers are made of relatively hard material.

41. The combination of claim 40 wherein said hard material is selected from the group consisting of i) steel
ii) steel alloy
iii) alnico
iv) sapphire.

42. The combination of claim 1 wherein said e) means to hold $^3$He liquid at a flow path outlet from the condenser-collector is an electrostatic force producing means.

43. The combination of claim 1 including a heat switch between the still and mixing chamber for assisting in a start-up of the refrigerator.

44. The combination of claim 1 including a $^3$He pot thermally coupled to the mixing chamber for assisting in start-up of the refrigerator.

45. The combination of claim 1 including means for producing electrostatic forces to position liquid at a capillary outlet from the condenser-collector, and utilizing saturated vapor pressure at the liquid-vapor interface in the condenser-collector, to drive the liquid through the flow path from the condenser-collector to the mixing chamber.

46. The combination of claim 45 wherein said means for producing electrostatic forces at the condenser-collector includes electrically conductive elements held at different electrical potentials.

47. The combination of claim 46 wherein said elements comprise diverging electrically conductive plates.

48. The combination of claim 46 wherein said elements comprise curved concentric electrically conductive plates having different radii of curvature.

49. The combination of claim 46 wherein said elements comprise conductors which are electrically charged to form fringing electrical fields near the edges of the conductors.

50. The combination of claim 45 including a heat reservoir, and a thermal impedance between the condenser-collector and the heat reservoir.

51. The combination of claim 50 including a heater means for changing the temperature of the liquid in the condenser-collector, thereby adjusting the saturated vapor-pressure in the condenser-collector, to control the rate of flow of liquid from the condenser-collector to the mixing chamber, and from the mixing chamber to the still.

52. The combination of claim 1 including the cooling power of the refrigerator matched to the load to be cooled, and including said load thermally coupled to the mixing chamber.

53. The combination of claim 1 wherein an electrostatic force producing means associated with sub-paragraph a) includes diverging conducting plates or curved concentric conducting plates having different radii of curvature, at different electrical potentials.

54. The combination in claim 1 wherein an electrostatic force producing means associated with sub-paragraph a) includes conductors which are electrically charged to form fringing electrical fields near the edges of conductors, held at different electrical potentials.

55. The combination of claim 1 including a heat switch means, for connecting each said adsorption pump to a thermal reservoir during the stage in which a pump adsorbs helium, and disconnects a pump from the thermal reservoir during helium desorption by the pump.

56. The combination of claim 55 including a thermal impedance means in series with a heat switch, or a heat switch system, for effecting elevation of the temperature of either adsorption pump above the temperature of the thermal reservoir when the switch is closed, to efficiently control the adsorption rate of helium at the pump.

57. The combination of claim 1 including a heater means at the sub-paragraph b) still for changing the temperature of the liquid in the still and thereby controlling the rate of evaporation at the still.

58. The combination of claim 1 including a controller for the sub-paragraph d) heater means to adjust the helium desorption or adsorption rate or rates at the pump or pumps.

59. The combination of claim 1 wherein the mixing chamber in a) includes apparatus for generating a non-uniform electric field with its greatest field intensity in the vicinity desired for a liquid $^4$He-rich phase, having relatively high dielectric constant, and lower field intensity in the vicinity desired for a liquid $^3$He-rich phase, having relatively low dielectric constant, under microgravity conditions.

60. The combination of claim 1 wherein the still in b) includes apparatus for generating a non-uniform electric field with its greatest field intensity in the vicinity desired for a helium liquid phase, having relatively high dielectric constant, and lower field intensity in the vicinity desired for a helium vapor phase, having relatively low dielectric constant, under microgravity conditions.

61. The combination of claim 1 wherein the condenser-collector in e) includes apparatus for generating a non-uniform electric field with its greatest field intensity in the vicinity desired for a helium liquid phase, having relatively high dielectric constant, and lower field intensity in the vicinity desired for a helium vapor phase, having relatively low dielectric constant, under microgravity conditions.

62. In combination, a) an electrostatic still for receiving a liquid mixture of $^3$He and $^4$He,
b) a porous plug, and
c) a chamber that intercommunicates the still and the plug and that has walls via which a film of said mixture migrates from the electrostatic still to the plug.

63. The combination of claim 62 including means for applying a voltage to plate means defined by the still, and a duct via which $^3$He is withdrawn from the plug, at reduced pressure.

64. The combination of claim 63 including a means for varying the voltage applied to the plate means at the still.

65. The combination of claim 62 including a film controlling plate extending transversely in said chamber, and forming a constricted through opening.

66. In a $^3$He—$^4$He dilution refrigerator, the combination comprising a) a mixing chamber containing $^3$He-rich and $^4$He-rich phases subject to separation in response to field force application, the chamber having an outlet for $^3$He that has passed through an interface between those two liquid phase to produce cooling, b) a still connected with the mixing chamber to receive $^3He$ therefrom, the still having an outlet for $^3He$, c) pump means connected with said still outlet to remove $^3He$ vapor from the still, d) and including a porous plug at the still and within which the interface between a liquid phase mixture of $^3He$ and $^4He$ (which is $^4He$-rich) and a vapor phase mixture of $^3He$ and $^4He$ (which is $^3He$-rich) is established for holding liquid in the still, thereby allowing selective evaporation of $^3He$ from the still during normal operation of the system.

67. The combination of claim 66 wherein said field force is gravitational, said phases in said chamber being separated by said field force.

68. The combination of claim 66 wherein said field force is electrostatic, said phases in said chamber being separated by said field force.

69. The combination of claim 66 wherein said field force is a combination of gravitational and electrostatic, said phases in said chamber being separated by said field force.

70. The combination of claim 1 including means operatively coupled in heat transfer relation to desorbed $^3He$ passed to the condenser-collector.

* * * * *

UNITED STATES PATENT AND TRADEMARK OFFICE

CERTIFICATE OF CORRECTION

PATENT NO. : 5,060,482

DATED : October 29, 1991

INVENTOR(S) : Henry W. Jackson

It is certified that error appears in the above-identified patent and that said Letters Patent is hereby corrected as shown below:

Title page, line 1 of title, "CONTINUOUSLY OPERATING 3HE-$^4$HE" should read --CONTINUOUSLY OPERATING $^3$HE-$^4$HE-- first page, first column, fourth reference "D. Petrac, U. E. Israelson, H. W. Jackson, "Electric" should read --D. Petrac, U. E. Israelsson, H. W. Jackson, "Electric-- first page, second column, seventh reference, "J. M. Meed & J. D. Craggs, *Electrical Breakdown of*" should read --J. M. Meek & J. D. Craggs, *Electrical Breakdown of* -- page 2, column 1, first reference "J. Gerhold, Dielectric Breakdown of Helium at Low" should read --J. Gerhold, Dielectric Breakdown of Helium at Low-- column 2, line 57 "condenser so than condensation of liquid occurs there," should read --condenser so that condensation of liquid occurs there,-- column 4, line 6, "FIG. 18 is a elevation in section. showing a combina-" should read --FIG. 18 is an elevation in section, showing a combina- -- column 4, line 58 "valve 20 is open and L valve 21 closed, the pump 18" should read --valve 20 is open and valve 21 closed, the pump 18--

UNITED STATES PATENT AND TRADEMARK OFFICE

CERTIFICATE OF CORRECTION

PATENT NO. : 5,060,482

DATED : October 29, 1991

INVENTOR(S) :

It is certified that error appears in the above-identified patent and that said Letters Patent is hereby corrected as shown below:

column 8, line 67, "neighboring parallel plates capacitors having different" should read --neighboring parallel plate capacitors having different--

Signed and Sealed this

Twenty-seventh Day of October, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 5,060,482

DATED : October 29, 1991

INVENTOR(S) : Henry W. Jackson

It is certified that error appears in the above-identified patent and that said Letters Patent is hereby corrected as shown below:

Title page, line 1 of title, "CONTINUOUSLY OPERATING 3HE-$^4$HE" should read --CONTINUOUSLY OPERATING $^3$HE-$^4$HE--

Title page, first column, fourth reference "D. Petrac, U. E. Israelson, H. W. Jackson, "Electric" should read --D. Petrac, U. E. Israelsson, H. W. Jackson, "Electric--

Title page, second column, seventh reference, "J. M. Meed & J. D. Craggs, *Electrical Breakdown of*" should read --J. M. Meek & J. D. Craggs, *Electrical Breakdown of* -- page 2, column 1, first reference "J. Cerhold, Dielectric Breakdown of Helium at Low" should read --J. Gerhold, Dielectric Breakdown of Helium at Low-- column 2, line 57 "condenser so than condensation of liquid occurs there," should read --condenser so that condensation of liquid occurs there,-- column 4, line 6, "FIG. 18 is a elevation in section, showing a combina-" should read --FIG. 18 is an elevation in section, showing a combina- -- column 4, line 58 "valve 20 is open and L valve 21 closed, the pump 18" should read --valve 20 is open and valve 21 closed, the pump 18-- column 8, line 67, "neighboring parallel plates capacitors having different" should read --neighboring parallel plate capacitors having different--

UNITED STATES PATENT AND TRADEMARK OFFICE
CERTIFICATE OF CORRECTION

PATENT NO. : 5,060,482

DATED : October 29, 1991

INVENTOR(S) : Henry W. Jackson

It is certified that error appears in the above-identified patent and that said Letters Patent is hereby corrected as shown below:

column 10, line 62, "$\vec{D}=E_oE_r\vec{E}\approx E_o\vec{E}$.)"

should read --$\vec{D}=\epsilon_o\epsilon_r\vec{E}\approx\epsilon_o\vec{E}$).-- column 17, line 1 "between those two liquid phase to produce cool-" should read --between those two liquid phases to produce cool- --

This certificate supercedes Certificate of Correction issued October 27, 1992.

Signed and Sealed this

Twenty-seventh Day of April, 1993

*Attest:*

MICHAEL K. KIRK

*Attesting Officer*

*Acting Commissioner of Patents and Trademarks*